US010904670B2

(12) United States Patent
Lee et al.

(10) Patent No.: US 10,904,670 B2
(45) **Date of Patent: *Jan. 26, 2021**

(54) DISPLAY APPARATUS

(71) Applicant: LG Display Co., Ltd., Seoul (KR)

(72) Inventors: Sungtae Lee, Incheon (KR); KwanHo Park, Incheon (KR); YeongRak Choi, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/806,327

(22) Filed: Mar. 2, 2020

(65) Prior Publication Data

US 2020/0204920 A1 Jun. 25, 2020

Related U.S. Application Data

(63) Continuation of application No. 15/915,458, filed on Mar. 8, 2018, now Pat. No. 10,609,487.

(30) Foreign Application Priority Data

Apr. 29, 2017 (KR) ..... 10-2017-0055809

(51) Int. Cl.

| | |
|---|---|
| ***H04R 7/04*** | (2006.01) |
| *H04R 9/06* | (2006.01) |
| *H04R 9/02* | (2006.01) |

(52) U.S. Cl.

CPC ..... *H04R 7/045* (2013.01); *H04R 9/025* (2013.01); *H04R 9/06* (2013.01); *H04R 2440/05* (2013.01); *H04R 2499/11* (2013.01); *H04R 2499/13* (2013.01); *H04R 2499/15* (2013.01)

(58) Field of Classification Search

CPC ..... H04R 7/045; H04R 9/025; H04R 9/06; H04R 2499/15

USPC ..... 381/152, 306, 333, 388, 396, 406, 191

See application file for complete search history.

(56) References Cited

U.S. PATENT DOCUMENTS

| | | | | |
|---|---|---|---|---|
| 7,560,863 | B2 | 7/2009 | Chung et al. | |
| 2004/0038722 | A1 | 2/2004 | Gauselmann | |
| 2005/0236956 | A1 | 10/2005 | Chung et al. | |
| 2005/0238196 | A1* | 10/2005 | Furuno ..... | H04N 5/642 381/386 |
| 2006/0159293 | A1* | 7/2006 | Azima ..... | B42D 15/022 381/152 |

(Continued)

FOREIGN PATENT DOCUMENTS

| | | | |
|---|---|---|---|
| CN | 1691851 | A | 11/2005 |
| CN | 202652283 | U | 1/2013 |

(Continued)

*Primary Examiner* — Melur Ramakrishnaiah

(74) *Attorney, Agent, or Firm* — Morgan, Lewis & Bockius LLP

(57) ABSTRACT

A display apparatus capable of realizing uniform sound wave and improved sound quality is provided. The display apparatus may include a display panel for displaying an image, a supporting member for supporting a rear surface of the display panel, at least one sound generating device disposed between the supporting member and the display panel, at least one partition provided at a predetermined interval from at least one sound generating device, and an adhesion member disposed in the periphery of the display panel.

28 Claims, 10 Drawing Sheets

(56) References Cited

U.S. PATENT DOCUMENTS

| | | | | |
|---|---|---|---|---|
| 2009/0097692 | A1* | 4/2009 | Sakamoto | H04R 7/045 381/388 |
| 2014/0301596 | A1* | 10/2014 | Wang | B06B 1/06 381/388 |
| 2015/0185963 | A1* | 7/2015 | Lee | H02J 7/025 345/177 |
| 2015/0341714 | A1 | 11/2015 | Ahn et al. | |
| 2016/0241938 | A1 | 8/2016 | Huang et al. | |

FOREIGN PATENT DOCUMENTS

| | | | |
|---|---|---|---|
| CN | 202663535 | U | 1/2013 |
| CN | 203086644 | U | 7/2013 |
| CN | 104751743 | A | 7/2015 |
| JP | 2017126048 | A | 7/2017 |

* cited by examiner

DISPLAY APPARATUS

CROSS REFERENCE TO RELATED APPLICATIONS

This application is a continuation of a co-pending U.S. patent application Ser. No. 15/915,458, filed Mar. 8, 2018, which claims the benefit of the Korean Patent Application No. 10-2017-0055809 filed on Apr. 29, 2017. All of the above-identified patent applications are hereby incorporated by reference as if fully set forth herein.

BACKGROUND

Field of the Disclosure

Embodiments of the present application relate to a display apparatus, and more particularly, to a display apparatus capable of generating sound by vibrating a display panel.

Discussion of the Related Art

With the advancement of an information-oriented society, various requirements for the display field of expressing information in accordance with an electric information signal are increasing, and thus, research is being conducted on various display devices that are thin, light, and have low power consumption.

For example, the display devices are categorized into a liquid crystal display (LCD) device, a field emission display (FED) device, an organic light emitting display (OLED) device, and a quantum dot display device.

Among the above display devices, the LCD device may include an array substrate including a thin film transistor, an upper substrate including a color filter and/or black matrix, and a liquid crystal layer interposed between the array substrate and the upper substrate. An alignment state of the liquid crystal layer is controlled based on an electric field applied to two electrodes of a pixel region, whereby light transmittance is adjusted based on the alignment state of the liquid crystal layer, to thereby display an image.

The OLED device, which is a self light emitting display device, has advantages of low power consumption, rapid response speed, high emission efficiency, high luminance and wide viewing angle.

SUMMARY

Generally, a display apparatus displays an image on a display panel, and an additional speaker for supplying sound has to be provided. If the speaker is provided in the display apparatus, the sound generated in the speaker advances toward a lower or rear side of the display panel instead of a front side of the display panel. Thus, the sound does not advance toward the front side of the display panel, for example, a user who watches the image displayed on the display panel so that it disrupts a user's sense of immersion.

When the sound generated in the speaker advances toward the lower or rear side of the display panel, sound quality is deteriorated due to an interference with sound reflected on the wall or floor.

If providing the speaker included in a set apparatus such as television, the speaker occupies a space so that it may cause limitations on design and arrangement of the set apparatus.

Accordingly, embodiments of the present disclosure are directed to a display apparatus that substantially obviates one or more of the problems due to limitations and disadvantages of the related art.

Through various experiments, a display apparatus, which facilitates to output sound to a front direction of a display panel, for example, a user who watches an image displayed on the display panel, and to improve sound quality, has been researched.

If a sound generating device is attached to a rear surface of a display panel, an excessively high vibration (peak) or an excessively low vibration (dip) generates by an overlapped vibration in a specific area of the display panel, or a vibration is not generated by an offset of vibrations in a specific area of the display pane, whereby it may cause a problem related with irregular sound. In order to output sound to a front direction of the display panel, and to improve sound quality, a display apparatus with a new structure of a sound generating device capable of optimizing a range of a sound vibration has been researched.

An aspect of embodiments of the present invention is to provide a display apparatus capable of outputting sound to a front direction of a display panel when a sound generating device is attached to a specific area of the display panel, and improving sound quality.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, a display apparatus comprises a display panel for displaying an image, a supporting member for supporting a rear surface of the display panel, at least one sound generating device disposed between the supporting member and the display panel, at least one partition provided at a predetermined interval from at least one sound generating device, and an adhesion member disposed in the periphery of the display panel.

In another aspect, a display apparatus comprises a display panel for displaying an image, at least one pair of sound generating devices on a rear surface of the display panel, a supporting member disposed on the rear surface of the display panel and provided to support at least one pair of sound generating devices, a partition for preparing a space in the display panel with respect to at least one pair of sound generating devices, and an adhesion member for adhering the display panel to the supporting member.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated and constitute a part of this application, illustrate embodiments of the disclosure and together with the description serve to explain various principles. In the drawings.

DETAILED DESCRIPTION

Figure 1A:
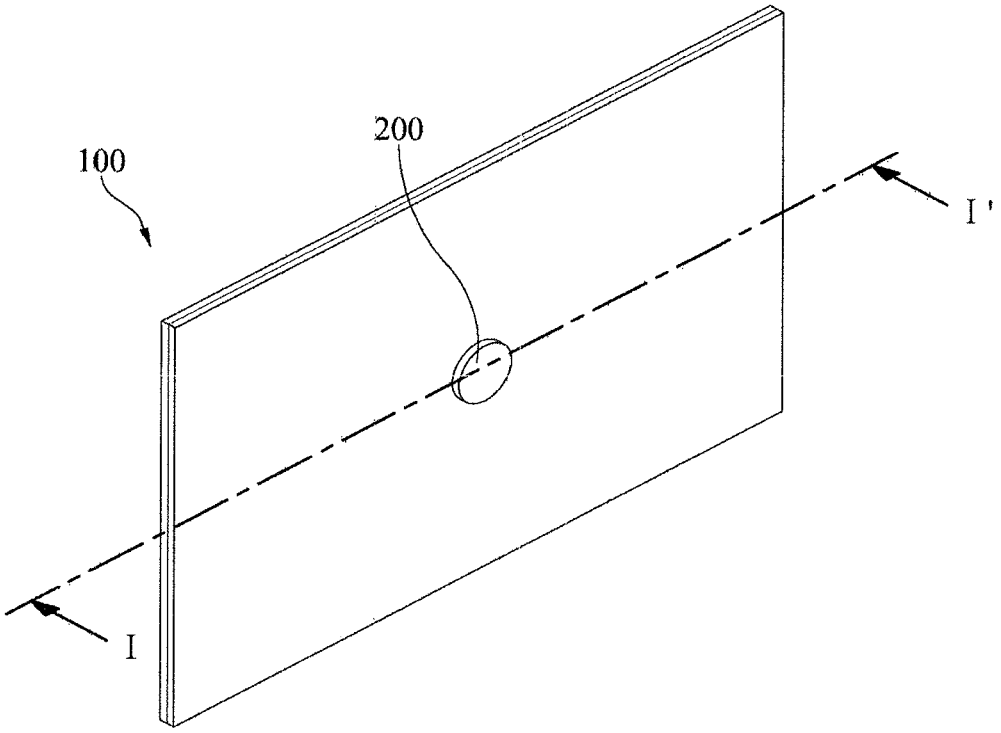
FIG. 1A illustrates a display apparatus including a sound generating device according to the embodiment of the present invention.

Reference will now be made in detail to the exemplary embodiments of the present application, examples of which are illustrated in the accompanying drawings. Wherever possible, the same reference numbers will be used throughout the drawings to refer to the same or like parts. Advantages and features of the present invention, and implementation methods thereof will be clarified through following embodiments described with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims.

A shape, a size, a ratio, an angle, and a number disclosed in the drawings for describing embodiments of the present invention are merely an example, and thus, the present invention is not limited to the illustrated details. Like reference numerals refer to like elements throughout. In the following description, when the detailed description of the relevant known function or configuration is determined to unnecessarily obscure the important point of the present invention, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error region although there is no explicit description.

In describing a position relationship, for example, when the positional order is described as 'on~', 'above~', 'below~', and 'next~', a case which is not contact may be included unless 'just' or 'direct' is used.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present invention.

In description of the present invention, the terms "first", "second", "A", "B", "(a)", "(b)", and etc. may be used herein to describe various elements. These terms are only used to distinguish one element from another. For example, the essence, order, sequence, or number of the corresponding elements is not limited by these terms. In description of embodiments of the present invention, when one structure is described as being "connected", "combined", or "contact" with another structure, this description should be construed as including a case where the structures contact each other and moreover, a case where a third structure is disposed therebetween.

In description of embodiments of the present invention, the display apparatus may include a liquid crystal module (LCM) including a display panel and a driver for driving the display panel, an organic light emitting display module (OLED), and a quantum dot module (QD). In addition, the display apparatus according to the present invention may also include equipment displays including complete product or final product of LCM, OLED, or QD module, for example, notebook computer, television, computer monitor, automotive display, or vehicle display, and set electronic devices or set device (set apparatus) such as mobile electronic devices of smart phone or electronic pad.

Accordingly, the display apparatus according to the present invention may include application products or set apparatuses such as final products including the LCM, OLED, and QD module as well as display apparatuses such as LCM, OLED, and QD module.

If needed, the LCM, OLED, and QD module provided with the display panel and the driver may be expressed as the display apparatus, and the electronic device of the final product including the LCM, OLED, and QD module may be expressed as the set apparatus. For example, in case of the display apparatus such as the LCM, OLED, and QD module, it may include a display panel, and a source printed circuit board (source PCB) corresponding to a controller for driving the display panel. Meanwhile, in case of the set apparatus, it may include a set PCB corresponding to a set controller, which is connected with the source PCB, so as to control the entire set apparatus.

The display panel used for the embodiment of the present invention may be all types of display panel, for example, a liquid crystal display panel, an organic light emitting diode display panel, a quantum dot display panel, an electroluminescent display panel, and etc., but not limited to these types. For example, the display panel of the present invention may be any panel capable of generating sound in accordance with a vibration by a sound generating actuator. Also, the display panel used for the embodiment of the present invention is not limited in its shape and size.

In more detail, in case of the liquid crystal display panel, it may include a plurality of gate lines, a plurality of data lines, and a plurality of pixels provided in respective intersections of the gate and data lines. Also, the liquid crystal display panel may include an array substrate including a thin film transistor corresponding to a switching device for controlling a light transmittance for each pixel, an upper substrate including a color filter and/or black matrix, and a liquid crystal layer formed between the array substrate and the upper substrate.

In case of the organic light emitting display panel, it may include a plurality of gate lines, a plurality of data lines, and a plurality of pixels provided in respective intersections of the gate and data lines. Also, the organic light emitting display panel may include an array substrate including a thin film transistor corresponding to a device for selectively applying a voltage to each pixel, an organic light emitting device layer on the array substrate, and an encapsulation substrate disposed on the array substrate so as to cover the organic light emitting device layer. The encapsulation substrate protects the thin film transistor and the organic light emitting device layer from an external shock, and prevents moisture or oxygen from being permeated into the organic light emitting device layer. Also, an inorganic light emitting layer may be provided on the array substrate, for example, nano-sized material layer or quantum dot.

The display panel may further include an additional metal plate, wherein the metal plate is attached to a rear surface (back) of the display panel, but not limited to this structure.

The display panel including the sound generating device according to the embodiment of the present invention may be a user interface module such as a central control panel of an automobile, which may be applied to a vehicle. For example, the display panel may be provided between occupants of two front seats so that a vibration of the display panel may be progressed toward the inside of the vehicle. Thus, in comparison to a speaker of an interior side inside the vehicle, the display panel enables an improved audio experience.

Features of various embodiments of the present invention may be partially or overall coupled to or combined with each other, and may be variously inter-operated with each other and driven technically as those skilled in the art can sufficiently understand. The embodiments of the present invention may be carried out independently from each other, or may be carried out together in co-dependent relationship.

Hereinafter, a display apparatus according to the embodiment of the present invention will be described in detail with reference to the accompanying drawings.

FIG. 1A illustrates a display apparatus including a sound generating device according to the embodiment of the present invention.

Referring to FIG. 1A, the display apparatus includes a display panel 100, and a sound generating device 200 for generating sound by vibrating the display panel 100. The sound generating device 200 may be referred to as an actuator, excitor, or transducer.

Figure 1B:
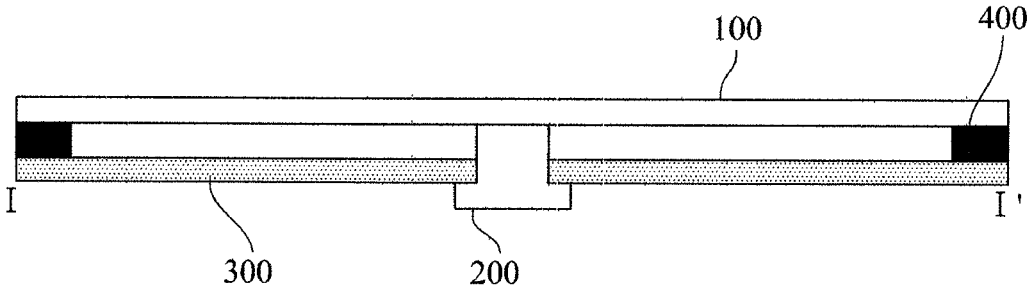
FIG. 1B is a cross sectional view along I-I' of FIG. 1A.

FIG. 1B is a cross sectional view along I-I' of FIG. 1A.

Referring to FIG. 1B, the display apparatus may include the sound generating device 200, and a supporting member 300.

The supporting member 300 may support at least one of rear and side (lateral) surfaces of the display panel 100. The sound generating device 200 may be fixed to the supporting member 300. Also, a thin film of a metal material having good thermal conductivity is additionally disposed between the rear surface of the display panel 100 and the sound generating device 200 so that it is possible to minimize an influence of heat, which is generated in the sound generating device 200, on a local area of the display panel 100.

In this specification, for example, the support member 300 may be a cover bottom. In addition, the supporting member 300 may include a middle cabinet provided to surround a lateral surface of the display panel 100, connected with the cover bottom, and provided to accommodate one edge of the display panel 100 so as to support the display panel 100. The supporting member 300 may include the cover bottom, or may include the cover bottom and the middle cabinet, but not limited to this structure. The supporting member 300 may include any structure capable of supporting the rear surface or lateral surface of the display panel 100.

The supporting member 300 may be a plate-shape member formed over a rear surface or entire surface of the display panel 100.

The supporting member 300 according to the present invention may be referred to as a cover bottom, a plate bottom, a back cover, a base frame, a metal frame, a metal chassis, a chassis base, or a m-chassis. Thus, the supporting member 300 may be embodied in all types of frame or plate-shape structure which is used as a supporter for supporting the display panel 100, and is disposed at the rear of the display apparatus. The supporting member 300 may be formed of any one material of metal, glass, and plastic materials, or may be formed of at least two of metal, glass, and plastic materials. Herein, the metal material may be aluminum (Al), but not limited to these materials.

Also, a partition may be provided between the supporting member 300 and the display panel 100. The partition may be an air gap of space for a sound generated when the display panel 100 vibrates. The air gap or space for generating or transferring the sound may be referred to as the partition, or it may be referred to as an enclosure or baffle, but not limited to these terms. The partition may be an entire area of four sides in the periphery of the display panel 100. The partition may have a sealed structure or unsealed structure.

Also, an adhesion member 400 is disposed in an edge of the supporting member 300 and the display panel 100. The adhesion member 400 is provided to adhere the display panel 100 and the supporting member 300 to each other, wherein the adhesion member 400 may be a double-sided tape.

According as the display apparatus according to the present invention includes the sound generating device 200 which vibrates the display panel 100 so as to generate the sound, it is possible to output the sound to the front direction of the display panel 100, and furthermore, to enhance a user's sense of immersion.

According as the display apparatus according to the present invention includes the sound generating device 200 which vibrates the display panel 100 so as to generate the sound, there is no need for an additional speaker, whereby it is impossible to realize good design of a set apparatus, and high selectivity in arrangement of a speaker.

Figure 2A:
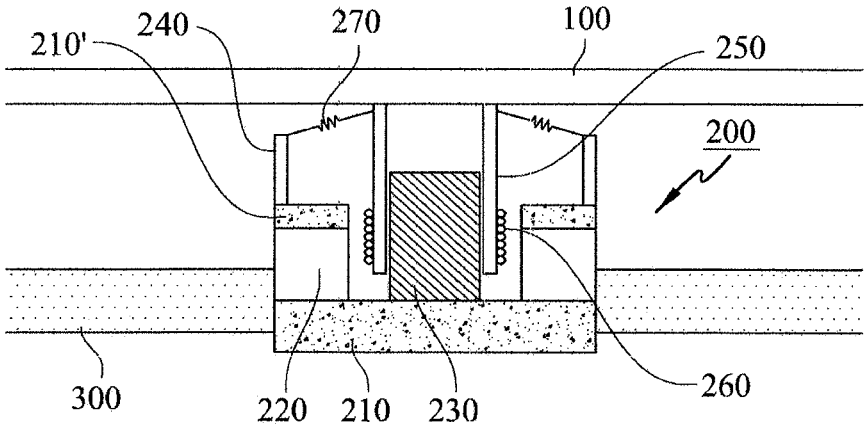
FIGS. 2A and 2B are cross sectional views illustrating the sound generating device according to the embodiment of the present invention.
Figure 2B:
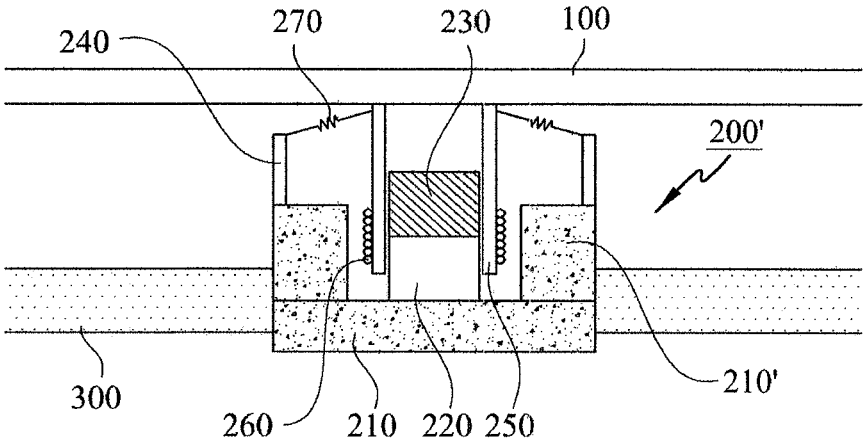

FIGS. 2A and 2B are cross sectional views illustrating the sound generating device according to the embodiment of the present invention.

The sound generating device may be categorized into a first structure corresponding to an external magnetic type where a magnet is disposed at an external side of a coil, and a second structure corresponding to an internal magnetic type where a magnet is disposed at an internal side of a coil. The first structure may be expressed as a dynamic type or external magnetic type, and the second structure may be expressed as a micro type or internal magnetic type.

FIG. 2A illustrates the first structure, and FIG. 2B illustrates the second structure.

Referring to FIG. 2A, the sound generating device 200 may include plates 210 and 210', a magnet 220 on the plate 210, a center pole 230 on the plate 210, a bobbin 250 disposed around the center pole 230, and a coil 260 wound on an outer surface of the bobbin 250.

In detail, the magnet 220 is disposed on the first plate 210, and the second plate 210' is disposed on the magnet 220. The first plate 210 and the second plate 210' support the magnet 220, and fixes the sound generating device 200 to the supporting member 300. Accordingly, the first plate 210 may be fixed to a supporting hole of the supporting member 300, and the magnet 220 may be fixedly supported between the first plate 210 and the second plate 210'.

At least one of the first plate 210 and the second plate 210' may be formed of a magnetic material such as iron (F). The first plate 210 and the second plate 210' are not limited to these terms, and they may be referred to as yokes.

The magnet member 220 may use a sintered magnet of barium ferrite, and the magnet member 220 may be formed of ferric oxide ($Fe_2O_3$), barium carbonate ($BaCO_3$), neodymium (Nd) magnet, strontium ferrite with improved magnetism, aluminum (Al), nickel (Ni), or alloy-casting magnet of cobalt (Co), but not limited to these materials. For example, the neodymium magnet may be neodymium-iron-boron (Nd—Fe—B).

Then, a frame 240 is disposed on the second frame 210' along the periphery of the first plate 210. The center pole 230 is disposed on the center of the first plate 210, wherein the center pole 230 may be referred to as a pole piece. The center pole 230 and the first plate 210 may be formed as one body.

The bobbin 250 is disposed to surround the center pole 230. The coil 260 is wound on a lower outer area, for example, a lower outer surface of the bobbin 250, wherein a current for generating sound is applied to the coil 260.

The bobbin 250 may be a ring-shaped structure of paper or aluminum sheet, and the coil 260 is wound on a predetermined area of the lower side of the bobbin 250. The bobbin 250 and the coil 260 may be expressed as a voice coil.

A damper 270 may be disposed between a predetermined area of an upper side of the bobbin 250 and the frame 240, wherein the damper 270 may be referred to as an edge.

FIG. 2B illustrates the second structure where a magnet is disposed at an internal side of a coil.

Referring to FIG. 2B, the sound generating device 200 includes a magnet 220 on a first plate 210, a center pole 230 on the magnet 220, a bobbin 250 disposed around the magnet 220 and the center pole 230, and a coil 260 wound on an outer surface of the bobbin 250.

In detail, the first plate 210 may be fixed to a supporting hole of the supporting member 300. The magnet 220 is disposed on the first plate 210, and the center pole 230 is disposed on the magnet 220.

The bobbin 250 is disposed to surround the magnet 220 and the center pole 230, and the coil 260 is wound on the outer surface of the bobbin 250.

A second plate 210' is disposed on the periphery of the first plate 210, and a frame 240 is disposed on the periphery of the second plate 210'. Also, a damper 270 is disposed between the frame 240 and the bobbin 250.

In comparison to the first structure where the magnet is disposed at the external side of the coil, the second structure has advantages of small leakage flux and decreased entire size.

The sound generating device used for the display apparatus according to the embodiment of the present invention is not limited to the structures of the FIGS. 2A and 2B. It is possible to use any sound generating device capable of generating the sound by vibrating the display panel.

Figure 3A:
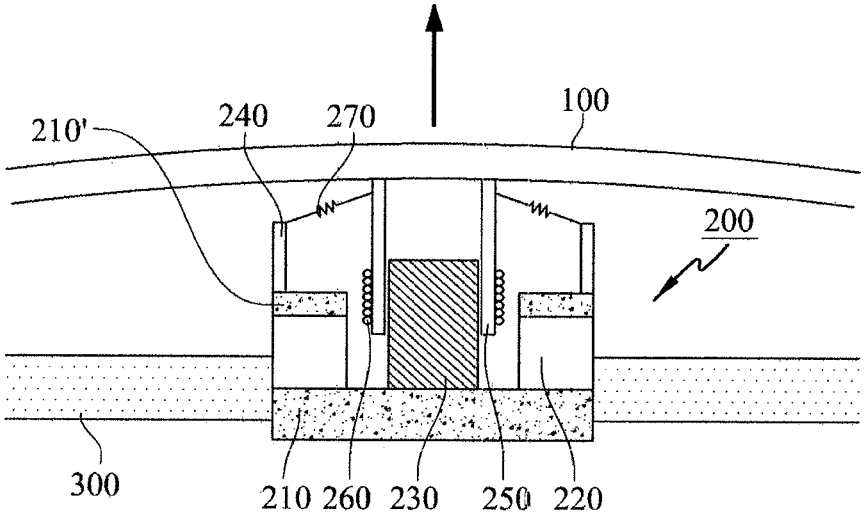
FIGS. 3A and 3B illustrate a sound generating method of the sound generating device with a first structure according to the embodiment of the present invention.
Figure 3B:
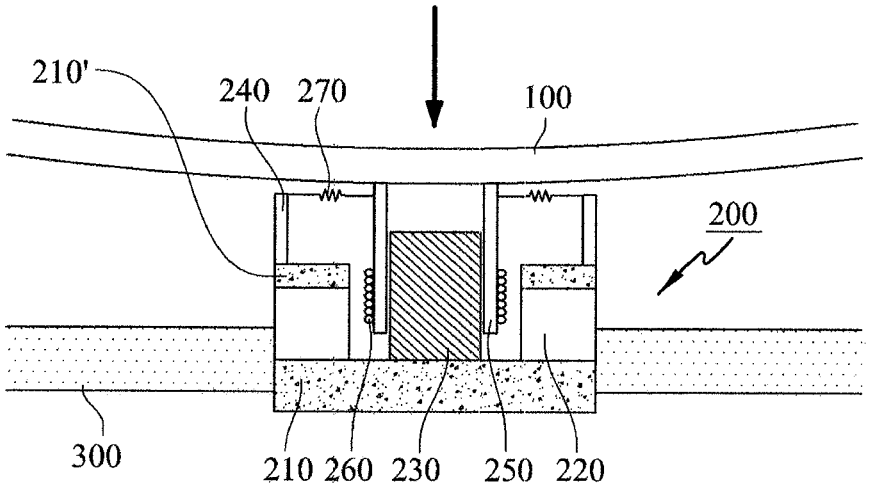

FIGS. 3A and 3B illustrate a sound generating method of the sound generating device with the first structure according to the embodiment of the present invention.

FIG. 3A illustrates a current-applied state.

Referring to FIG. 3A, the center pole 230 connected with a lower surface of the magnet 220 becomes the N pole, and the first plate 210 connected with an upper surface of the magnet 220 becomes the S pole, whereby an external magnetic field is generated inside the coil 2 60. In this case, if the current for generating sound is applied to the coil 260, an applied magnetic field is formed around the coil 260, whereby a force for upwardly moving the bobbin 250 is generated by the applied magnetic field and the external magnetic field. In detail, if the current is applied to the coil 260, the magnetic field is generated around the coil 260, and the external magnetic field is generated by the magnet 220, whereby the entire bobbin 250 is guided and moved upward by the center pole 230 based on Fleming's left hand rule.

According as one surface of the bobbin 250 is in contact with the rear surface of the display panel 100, the display panel 100 is vibrated in an upper direction (indicated by an arrow) according to whether or not the current is applied to the coil 260, and sound wave (or sound) is generated by the vibration of the display panel 100.

Referring to FIG. 3B, if the current is stopped or its opposite directional current is applied, a force of downwardly moving the bobbin 250 is generated based on principles of FIG. 3A, whereby the display panel 100 is vibrated in a lower direction (indicated by an arrow).

The damper 270 is disposed between the frame 240 and the upper side of the bobbin 250. The damper 270 is formed in a wrinkled structure having elasticity, whereby the damper 270 controls the up-and-down vibration of the bobbin 250 by contraction and relaxation movements in accordance with the up-and-down movement of the bobbin 250. For example, the damper 270 is connected with the bobbin 250 and the frame 240, whereby the up-and-down vibration of the bobbin 250 may be controlled by a restoring force of the damper 270. In detail, if the bobbin 250 vibrates to be higher or lower than a predetermined height, the bobbin 250 may be restored to its original position by the restoring force of the damper 270.

According to the direction and level of the current applied to the coil 260, the display panel 100 may be vibrated in the up-and-down direction so that it is possible to generate the sound wave by the vibration.

Figure 4A:
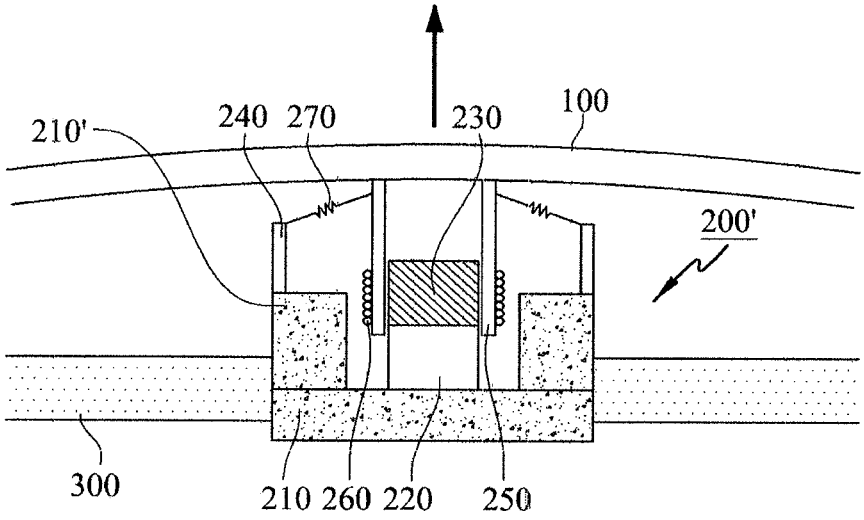
FIGS. 4A and 4B illustrate a sound generating method of the sound generating device with a second structure according to the embodiment of the present invention.
Figure 4B:
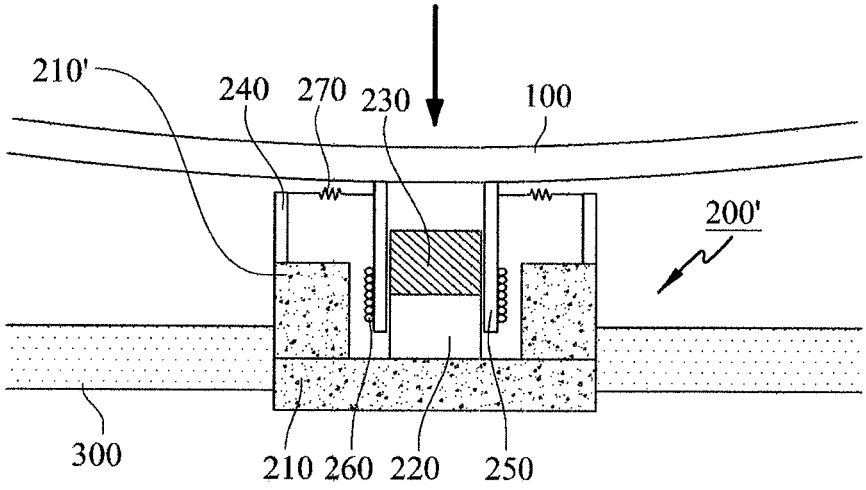

FIGS. 4A and 4B illustrate a sound generating method of the sound generating device with the second structure according to the embodiment of the present invention.

FIG. 4A illustrates a current-applied state.

Referring to FIG. 4A, the second plate 210' becomes the N pole, and the center pole 230 connected with an upper surface of the magnet 220 becomes the S pole, whereby an external magnetic field is generated inside the coil 2 60. In this case, if the current for generating sound is applied to the coil 260, an applied magnetic field is formed around the coil 260, whereby a force for upwardly moving the bobbin 250 is generated by the applied magnetic field and the external magnetic field. In detail, if the current is applied to the coil 260, the magnetic field is generated around the coil 260, and the external magnetic field is generated by the magnet 220, whereby the entire bobbin 250 is guided and moved upward by the center pole 230 based on Fleming's left hand rule.

According as one surface of the bobbin 250 is in contact with the rear surface of the display panel 100, the display panel 100 is vibrated in an upper direction (indicated by an arrow) according to whether or not the current is applied to the coil 260, and sound wave (or sound) is generated by the vibration of the display panel 100.

Referring to FIG. 4B, if the current is stopped or its opposite directional current is applied, a force of downwardly moving the bobbin 250 is generated based on principles of FIG. 4A, whereby the display panel 100 is vibrated in a lower direction (indicated by an arrow).

The damper 270 is disposed between the frame 240 and the upper side of the bobbin 250. The damper 270 is formed in a wrinkled structure having elasticity, whereby the damper 270 controls the up-and-down vibration of the bobbin 250 by contraction and relaxation movements in accordance with the up-and-down movement of the bobbin 250. For example, the damper 270 is connected with the bobbin 250 and the frame 240, whereby the up-and-down vibration of the bobbin 250 may be controlled by a restoring force of the damper 270. In detail, if the bobbin 250 vibrates to be higher or lower than a predetermined height, the bobbin 250 may be restored to its original position by the restoring force of the damper 270.

Accordingly, the display panel 100 may be vibrated in the up-and-down direction in accordance with the direction and level of the current applied to the coil 260, to thereby generate the sound wave by the vibration.

Figure 5A:
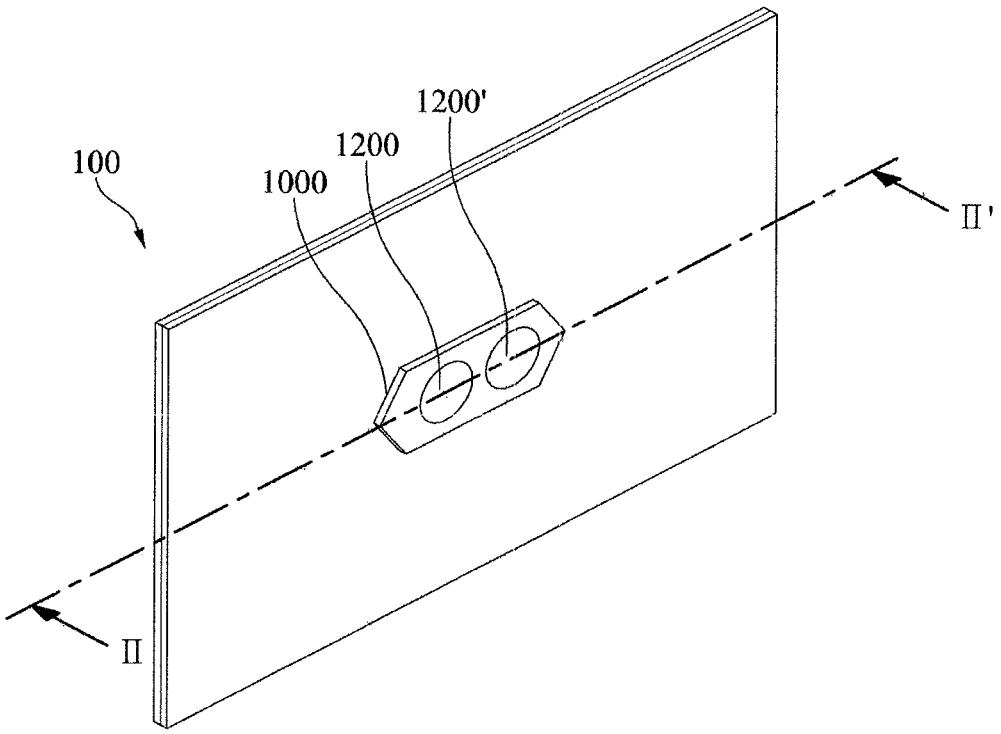
FIG. 5A illustrates a sound generating device according to another embodiment of the present invention.
Figure 5B:
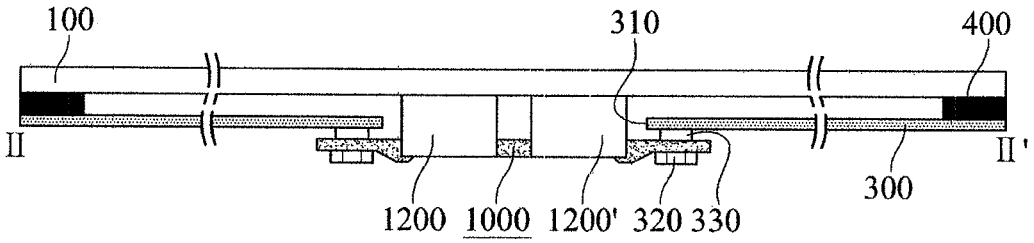
FIG. 5B is a cross sectional view along II-II' of FIG. 5A.

FIG. 5 illustrates a sound generating device according to another embodiment of the present invention. FIG. 5A is a plane view illustrating the sound generating device according to another embodiment of the present invention, and FIG. 5B is a cross sectional view along II-IP of FIG. 5A.

Referring to FIG. 5A, a display apparatus may include a display panel 100, and first and second sound generating devices 1200 and 1200' for generating sound by vibrating the display panel 100.

The first sound generating device 1200 and the second sound generating device 1200' are disposed adjacent to each other. If providing the plurality of sound generating devices at fixed intervals, it is difficult to maintain uniformity of contact properties between the sound generating device and the display panel, which might cause deterioration of sound quality by an interference or delay phenomenon of the sound wave generated in the sound generating devices. In comparison to the plurality of sound generating devices provided at fixed intervals, the sound generating devices disposed adjacent to each other may reduce an interference or delay phenomenon of the sound wave generated in the sound generating devices, to thereby improve the sound output properties. This will be described in detail with reference to FIG. 7.

A structure of each of the first sound generating device 1200 and the second sound generating device 1200 is the same as a structure of the sound generating device shown in FIGS. 2A and 2B.

There is a fixing device 1000 for fixing the first sound generating device 1200 and the second sound generating device 1200'. The fixing device 1000 may be a mold structure manufactured by a molding process using a plastic material, but not limited to this type. The fixing device 1000 will be described with reference to FIG. 6.

Referring to FIG. 5B, the display apparatus may include the first sound generating device 1200, the second sound generating device 1200', and a supporting member 300.

The supporting member 300 may support at least one of rear and side surfaces of the display panel 100. The supporting member 300 may be a plate-shape member of a metal or plastic material over a rear surface or entire surface of the display panel 100.

The sound generating device 1200 and 1200' may be received in a supporting hole 310 of the supporting member 300. If the sound generating device 1200 and 1200' is inserted into and fixed to the supporting hole 310, it is possible to decrease a height of the sound generating device 1200 and 1200' disposed between a rear surface of the display panel 100 and an inner surface of the supporting member 300, to thereby realize a small space or area for generating the sound.

In addition, there is a nut 330 fixed to the supporting member 300. The fixing device 1000 may be fixed to the nut 330 by the use of screw 320 inserted into a hole of the fixing device 1000. Also, a screw through hole is formed inside the nut 330. Thus, after aligning the hole of the fixing device 1000 and the screw through hole of the nut 330, the screw 320 is tightened up so that the fixing device 1000 is fixed to the supporting member 300.

For example, the nut 330 may be a self-clinching nut. One example of the self-clinching nut may be a pem nut.

If using the pem nut, the vibration generated in the sound generating device 1200 is partially absorbed in the pem nut so that it is possible to reduce the vibration transferred to the supporting member 300.

In the display apparatus according to the present invention, the supporting member 300 and the sound generating device 1200 are fixed to each other by the use of nut and screw included in the supporting member 300 so that it is possible to reduce a thickness of the display panel 100.

Also, an adhesion member 400 may be disposed along the edge of the supporting member 300 and the display panel 100. The adhesion member 400 may be disposed in the periphery of the supporting member 300, to thereby adhere the display panel 100 and the supporting member 300 to each other. The adhesion member 400 may be a double-sided tape.

Figure 6:
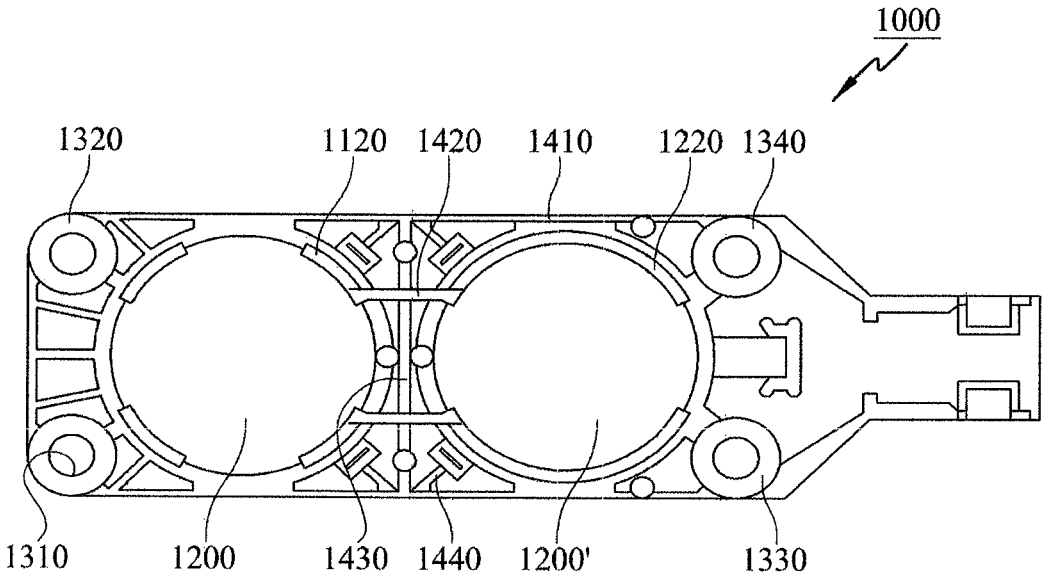
FIG. 6 illustrates a fixing device of the sound generating device according to another embodiment of the present invention.

FIG. 6 illustrates another example of the fixing device in the sound generating device according to the present invention.

Referring to FIG. 6, the fixing device 1000 of the sound generating device may be an integrated type fixing device for supporting and fixing the first sound generating device 1200 and the second sound generating device 1200 being adjacent to each other. The fixing device 1000 of the sound generating device may include a supporting portion for supporting the sound generating device 1200 and 1200', a plurality of rib portions disposed in the periphery of the sound generating device 1200 and 1200', and a plurality of holes for fixing the fixing device 1000 and the supporting member 300 to each other.

In detail, the supporting portion may include a first supporting portion 1120 for supporting the first sound generating device 1200, and a second supporting portion 1220 for supporting the second sound generating device 1200'. The first supporting portion 1120 supports predetermined portions of lateral and rear surfaces of the first sound generating device 1200, wherein the first supporting portion 1120 may have a cylinder shape. The second supporting portion 1220 supports predetermined portions of lateral and rear surfaces of the second sound generating device 1200', wherein the second supporting portion 1220 may have a cylinder shape.

The first supporting portion 1120 and the second supporting portion 1220 may further include two or four circular-arc protrusions. Herein, one surface of each of the protrusions is bent toward the inside of each sound generating device 1200 and 1200' so that it is possible to support a predetermined portion of a rear surface of each sound generating device 1200 and 1200', to thereby prevent the sound generating device 1200 and 1200' from being separated from the fixing device 1000.

Also, the plurality of rib portions may be disposed in the periphery of the first supporting portion 1120 and the second supporting portion 1220, thereby maintaining harness of the fixing device 1000 and preventing a deformation of the fixing device 1000 of the sound generating device even in a case of long-time use.

In more detail, the plurality of rib portions may include the first rib portion 1410 which extends from the outer surface of the first supporting portion 1120 and the second supporting portion 1220 in a width direction, the second rib portion 1420 for connecting the first supporting portion 1120 and the second supporting portion 1220 with each other in the width direction, and the third rib portion 1430 connected with the first rib portion 1410 in a length direction. Herein, the width direction is a direction of a long side along which the two sound generating devices are disposed, and the length direction is a direction which is perpendicular to the width direction.

The first rib portion 1410 extends from the outer surface of the first supporting portion 1120 and the second supporting portion 1220 in the width direction, to thereby form a width-direction external structure of the fixing device 1000 of the sound generating device.

A central area of the first rib portion 1410, For example, a central area between the first supporting portion 1120 and the second supporting portion 1220 may be relatively higher or thicker than each of both side areas of the first rib portion 1410. Accordingly, even though the two sound generating devices are vibrated for a long time period, it is possible to prevent the fixing device 1000 of the sound generating device from being deformed, and to reduce a change of a relational position between the display panel and the two sound generating devices.

At least one of second rib portion 1420 may be disposed inside the first rib portion 1410, wherein the second rib portion 1420 may be connected with the first supporting portion 1120 and the second supporting portion 1220 and formed as one body with the first supporting portion 1120 and the second supporting portion 1220.

In FIG. 6, two of the second rib portion 1420 are shown, but not limited to this structure. For example, one or three of the second rib portion 1420 may be provided.

Between two of the second rib portion 1420 or two of the first rib portion 1410, at least one third rib portion 1430 extending in the length direction may be connected with the first rib portion 1410 and the second rib portion 1420.

In FIG. 6, one of the third rib portion 1430 is shown, and the long third rib portion 1430 extends in the length direction between two of the first rib portions 1410, but not limited to this structure. For example, the third rib portion 1430 may extend short between two of the second rib portions 1420.

Between the first supporting portion 1120 and the first rib portion 1410, or between the second supporting portion 1220 and the first rib portion 1410, at least one of fourth rib portion 1440 may be obliquely provided so as to prevent the fixing device 1000 of the sound generating device from being bent by heat generated by a long-time use.

The display apparatus according to the present invention includes the fixing device 1000 for fixing one pair of sound generating devices, and the plurality of rib portions in the periphery of the sound generating device so that it is possible to maintain hardness of the sound generating device, and to minimize the change of sound output properties even in a case of long-time use.

An interval distance between the first supporting portion 1120 and the second supporting portion 1220 may be larger than a minimum critical value for forming the rib portion, and may be smaller than a maximum critical value corresponding to a diameter of each of the first sound generating device 1200 and the second sound generating device 1200'. If the interval distance between the first supporting portion 1120 and the second supporting portion 1220 is larger than the minimum critical value, the sound quality may be deteriorated. Thus, the interval distance between the first supporting portion 1120 and the second supporting portion 1220 is smaller than the diameter of each of the first sound generating device 1200 and the second sound generating device 1200', to thereby prevent deterioration of the sound quality. For example, if the sound generating device has size (diameter) 'D', the interval distance between the first supporting portion 1120 and the second supporting portion 1220 is set to be a value which is larger than about 7 mm corresponding to the minimum critical value, and is smaller than the size 'D' of the sound generating device. If the size 'D' of the sound generating device is about 28 mm, in case of about 0.85D (dir 23.6 mm), there is only a slight different in the sound output properties.

There are the plurality of holes for fixing the fixing device 1000 and the supporting member 30 to each other. The screw through hole is formed in the inner surface of the nut 330 shown in FIG. 5B. Thus, after aligning the hole 1310, 1320, 1330, and 1340 of the fixing device 1000 and the screw through hole of the nut 330, the screw 320 is tightened up so that the fixing device 1000 is fixed to the supporting member 300.

Figure 7:
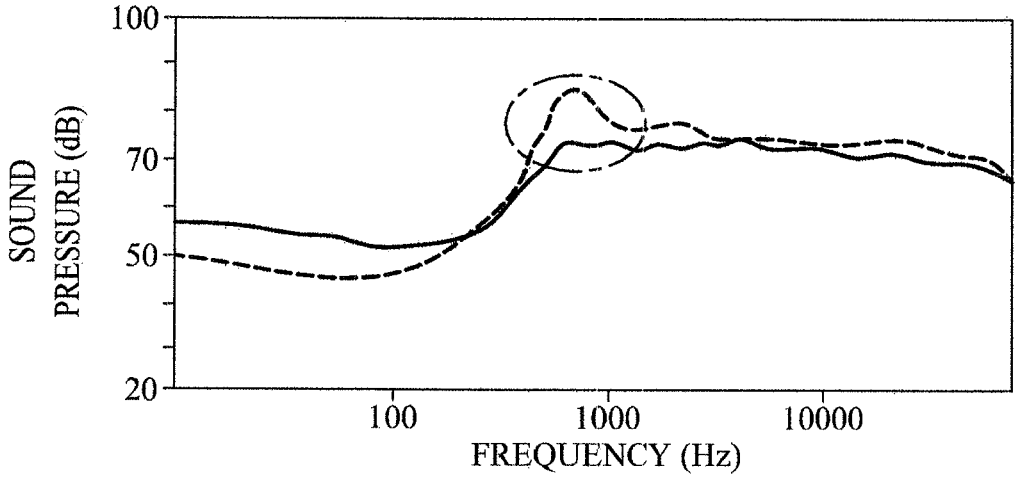
FIG. 7 illustrate the sound output properties in the sound generating device according to another embodiment of the present invention.

FIG. 7 illustrate the sound output properties of another example in the sound generating device according to the embodiment of the present invention.

In FIG. 7, a dotted line indicates a case where the two sound generating devices are provided at a predetermined interval from each other, and are separately fixed. In this case, a dip phenomenon (indicated by a circle) may occur by a sudden raise of sound pressure in 800~900 Hz range.

Due to the dip phenomenon, a strong sound pressure is generated in a specific frequency by an interference or delay of the sound wave generated in the two sound generating devices which are provided at a predetermined interval from each other and are fixed separately, which might cause deterioration of sound quality.

In FIG. 7, a solid line indicates a case where the fixing device 1000 of the sound generating device is used to fix the two sound generating devices to each other. In comparison to the dotted line of FIG. 7, the solid line of FIG. 7 shows that the dip phenomenon caused by the abnormally-increased sound pressure in the specific frequency is removed significantly.

If applying the fixing device 1000 of the sound generating device according to another embodiment of the present invention, it is possible to maintain uniform sound pressure in the entire frequency range, to thereby improve the sound output properties.

Figure 8:
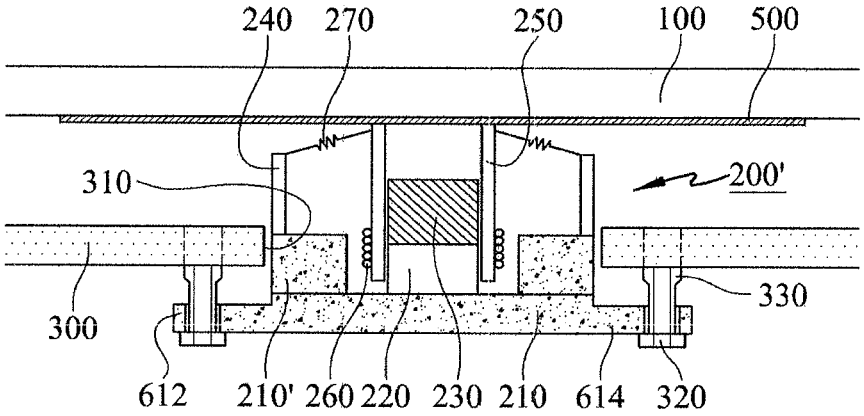
FIG. 8 illustrates a connection structure between a sound generating device and a supporting member according to the embodiment of the present invention.

FIG. 8 illustrates a connection structure between the sound generating device and the supporting member according to another embodiment of the present invention.

The embodiment of the present invention may be applied to both the first and second structures of the sound generating device. Hereinafter, an example of the second structure of the sound generating device will be described in detail.

Referring to FIG. 8, an expanded-diameter portion 614 is additionally provided, wherein the expanded-diameter portion 614 is formed as one body with the first plate 210 of the sound generating device 200'. The first plate 210 of the sound generating device 200' is not a cylinder shape. Herein, one side of the first plate 210 has a protrusion portion which is larger than a diameter of the remaining area of the first plate 210. The protrusion portion with a relatively-large diameter may be referred to as the expanded-diameter portion 614. The expanded-diameter portion 614 has a ring shape, and an extending portion 612 for fixation of the sound generating device 200' is formed in a predetermined portion of the expanded-diameter portion 614.

In the extending portion 612, there are a screw 320 and a nut 330. By the use of nut 330 fixed to the supporting member 300, the sound generating device 200 is connected with the supporting member 300 by the screw 320. For example, the nut 330 may be a self-clinching nut. One example of the self-clinching nut may be a pem nut.

If using the pem nut, the vibration generated in the sound generating device 1200 is partially absorbed in the pem nut so that it is possible to reduce the vibration transferred to the supporting member 300.

A heat diffusion plate 500 may be disposed between the sound generating device 200' and the display panel 100. The heat diffusion plate 500 may be formed of a material with good thermal conductivity so as to minimize an influence of heat, which is generated by the vibration of the sound generating device 200, on the display panel 100. For example, the heat diffusion plate 500 may be formed of a metal material such as aluminum (Al) or copper (Cu), but not limited to these materials.

Figure 9:
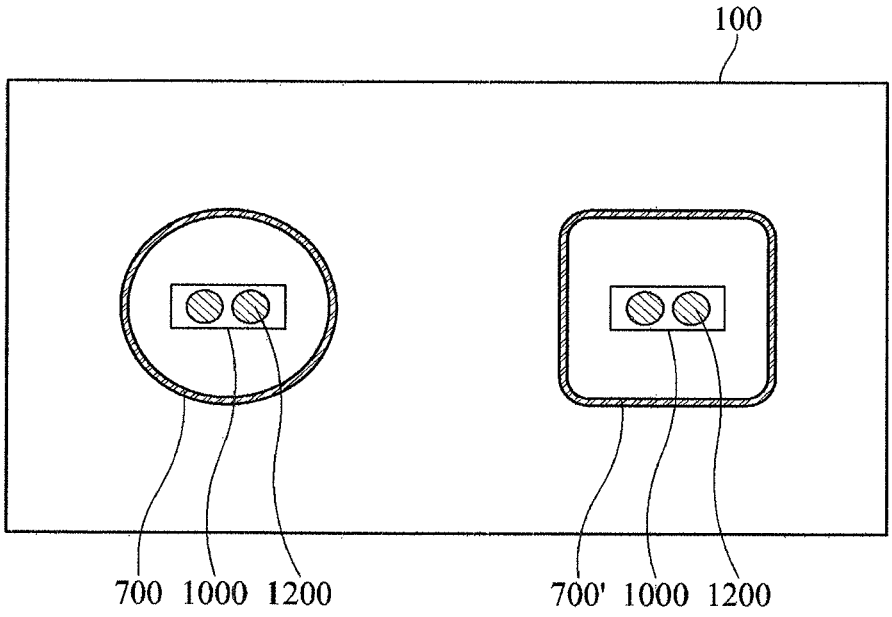
FIG. 9 illustrates that the sound generating device and partitions are connected with a rear surface of a display panel according to the embodiment of the present invention.

FIG. 9 illustrates an example of the sound generating device 1200 and partitions 700 according to the embodiment of the present invention.

As shown in FIG. 6, the fixing device 1000 for fixing the two sound generating devices 1200 and 1200' as one body may be disposed in each of left and right areas of the display panel 100.

The first partition 700 is disposed for the sound generating device 1200 disposed in the left area of the rear surface of the display panel 100, and the second partition 700' is disposed for the sound generating device 1200 disposed in the right area of the rear surface of the display panel 100. For example, the first partition 700 may have a circle shape for surrounding the sound generating device 1200, and the second partition 700' may have a polygonal shape for surrounding the sound generating device 1200.

However, it is not limited to the aforementioned structure. For example, the first and second partitions 700 and 700' may be disposed at the opposite positions. In detail, the second partition 700' may be disposed in the left area, and the first partition 700 may be disposed in the right area.

The sound generating device of the left area may be disposed in the central area of the first partition 700. The sound generating device of the left area may be disposed more toward any one side of the first partition in accordance with a shape of sound vibration. The first partition 700 may be formed in an oval shape obtained by changing a curvature of a circular shape. The sound generating device of the right area may be disposed in the central area of the second partition 700'. The sound generating device of the right area may be disposed more toward any one side of the second partition in accordance with a shape of sound vibration, or the second partition 700' may be formed in a polygonal shape whose internal angle is an acute angle or obtuse angle.

In case of the first partition 700 having the same radius with respect to the sound generating device 1200, a transmission and reflection of the sound vibration from the sound generating device 1200 to the partition is constant, whereby it enables the regular sound wave without any infection point on a sound analysis. Meanwhile, in case of the second partition 700, the sound vibration is smoothly formed in comparison to a case without the partition, and it enables a reasonable cost and an easy installation and change by combining a linear partition. In order to apply the second partition 700', the sound generating device 1200 may be formed in a polygonal shape so as to maintain a constant distance between the sound generating device 1200 and the partition.

An apparatus for analyzing the sound may include a sound card for receiving sound from a control PC, and transmitting sound to the control PC, an amplifier for amplifying the sound (signal) generated from the sound card, and transmitting the amplified sound to the sound generating device 1200, and a microphone for collecting the sound generated in the display panel through the sound generating device 1200. The sound collected in the microphone is provided to the control PC through the sound card, and then the control PC checks the provided sound, and analyzes the sound of the sound generating device 1200.

Figure 10:
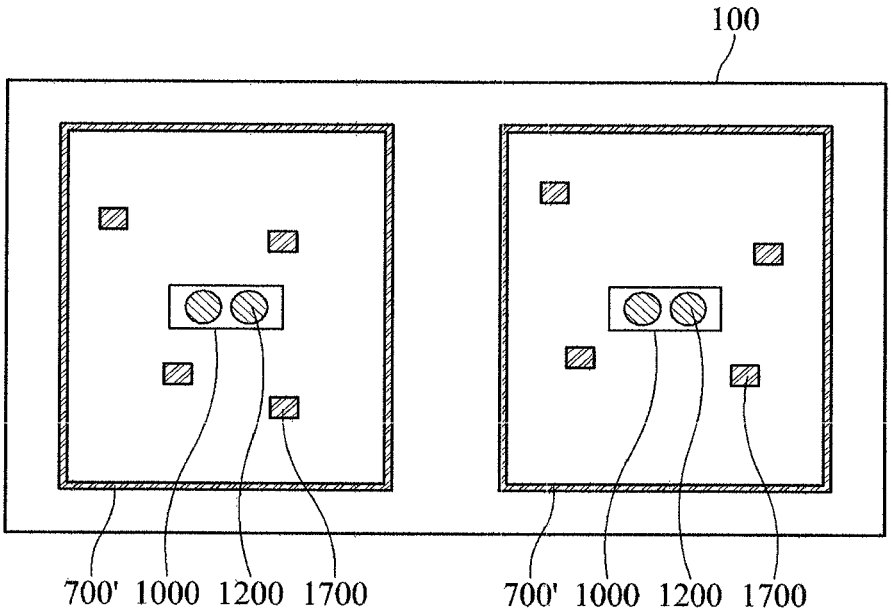
FIG. 10 illustrates that the sound generating device, partition, and node point according to the embodiment of the present invention are connected with a rear surface of a display panel.

FIG. 10 illustrates an example of the sound generating device 1200, partition 700', and node point 1700 according to the embodiment of the present invention.

As shown in FIG. 9, a shape of the partition 700 may be the circular shape or rectangular shape. Hereinafter, an example of the partition 700 having the rectangular shape will be described in detail. If the sound vibration generated in the sound generating device 1200 is reflected on the partition 700', and the reflected sound vibration and the sound vibration additionally generated in the sound generating device 1200 meets together, the sound vibration can be offset due to the mutual reversed polarity. For controlling the offset vibration, a partition piece whose material is the same as that of the partition 700' is attached to the corresponding position so as to prevent the mutual offset vibration between the reflected sound vibration and the generated sound vibration. This partition piece with this function is referred to as a partition resonance point 1700. The partition piece may be disposed at a constant distance or constant direction with respect to the sound generating device, as shown in FIG. 10. The partition resonance point 1700 may be set to be an optimal position by the use of laser doppler apparatus. The laser doppler apparatus injects laser rays onto the sound vibration surface, checks the shape of scattered laser rays, and checks the shape of spreading vibration. Thus, the amplification and offset position of the vibration may be analyzed, and the partition resonance point 1700 may be disposed at the offset vibration position.

Figure 11:
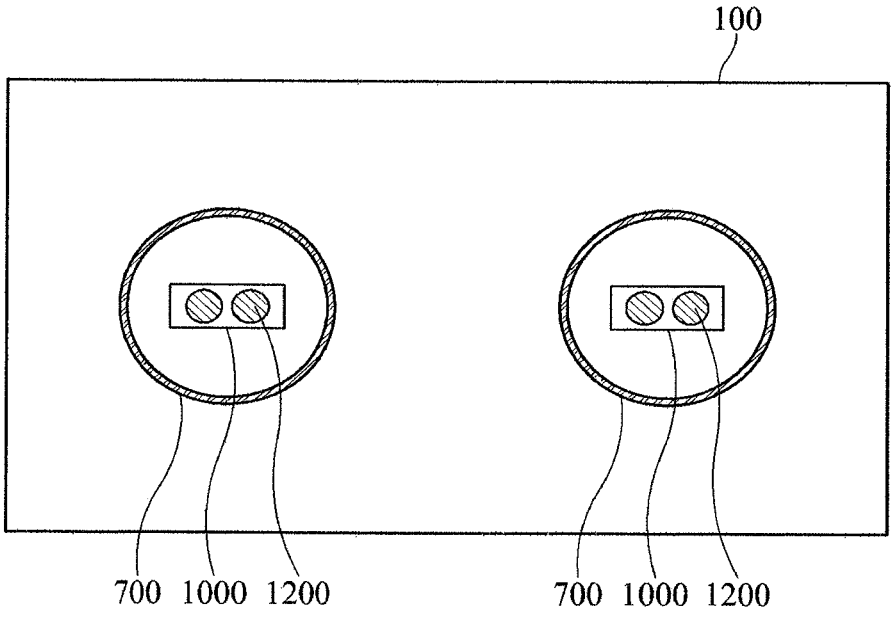
FIGS. 11, 12, 13, and 14 illustrate various shapes of connecting the sound generating device and partition with a rear surface of a display panel.

FIG. 11 illustrates another example of the sound generating device 1200 and partition 700 according to the embodiment of the present invention.

The sound generating device 1200 is disposed in the left area and the right area on the rear surface of the display panel 100, and the first partition 700 is disposed to surround the sound generating device 120. The first partition 700 may be formed in a circular shape or a polygonal shape such as a triangle.

Figure 12:
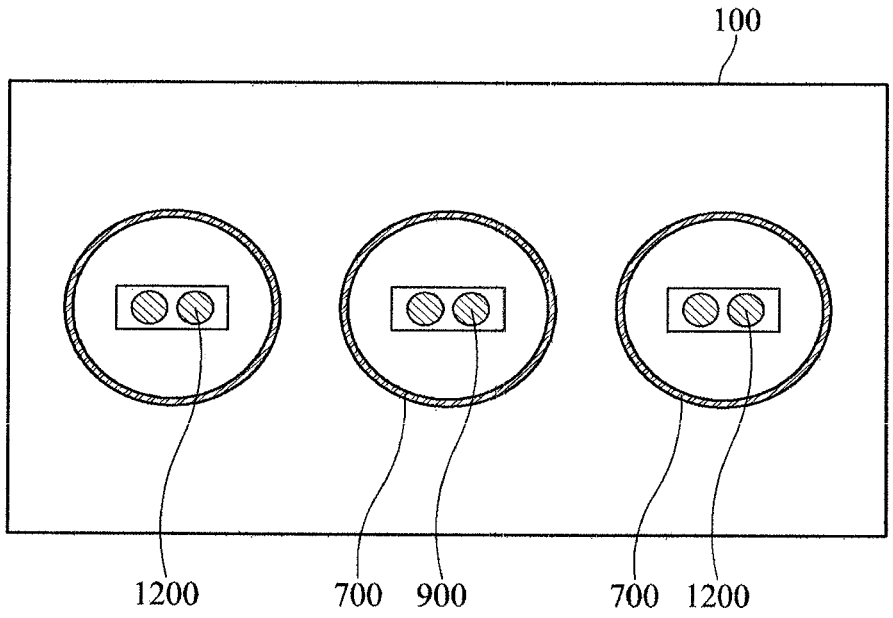

FIG. 12 illustrates another example of the sound generating device 1200 and partition 700 according to the embodiment of the present invention.

In addition to the sound generating devices 1200 disposed in the left area and the right area on the rear surface of the display panel 100, FIG. 12 shows an additionally provided low-range sound generating device 900 is disposed in the central area of the display panel 100. If combining the sound generating devices 1200 disposed in the left area and the right area of the display panel 100 with the low-range sound generating device 900, the low-range sound generating device 900 is used as a woofer speaker so that it is possible to realize the 2.1 channel type sound output properties. If the low-range sound generating device 900 is used as a central speaker, it is possible to realize the 3.1 channel type sound output properties, whereby it enables a wide-range sound vibration, and furthermore, it expresses the low-range sound as well as the middle-range and high-range sound.

In this case, the low-range sound is defined as the sound of 200 Hz or less than 200 Hz, the middle-range sound is defined as the sound between 200 Hz and 3 kHz, and the high-range sound is defined as the sound of 3 kHz or more than 3 kHz, but not limited to these ranges.

In this specification, there are a first method wherein a low-pitched sound threshold frequency of the low-range sound generating device 900 is lower than a low-pitched sound threshold frequency of the sound generating device 1200 disposed in each of the left area and the right area of the display panel 100, and a second method wherein a size of the central low-range sound generating device is larger than a size of the sound generating device 1200 disposed in each of the left area and the right area of the display panel 100. Herein, the low-pitched sound threshold frequency corresponds to a threshold value of a reproductive frequency band in each sound generating device, which indicates a frequency of the lowest-range sound wave generated in each sound generating device, which may be expressed as a minimum resonance frequency.

Accordingly, the low-range sound is louder than the middle-range and high-range sound, to thereby improve the low-range sound output properties.

The embodiment of the present invention may be selectively applied to any one of the first method and the second method without any restriction.

Figure 13:
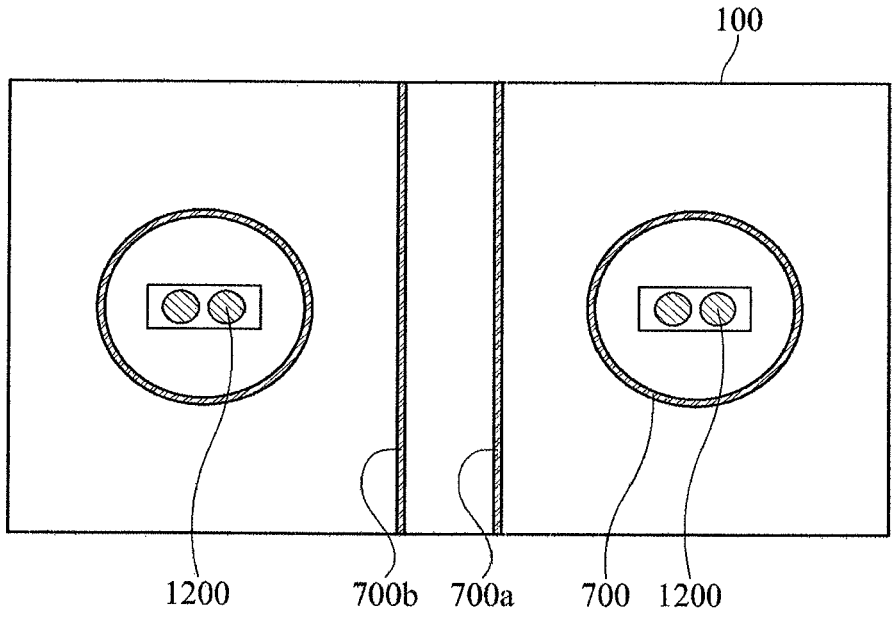

FIG. 13 illustrates an example of the sound generating device 1200 and partition 700 according to the embodiment of the present invention.

In addition to the structure of FIG. 11, one pair of partitions 700*a* and 700*b*, which vertically crosses the rear surface of the display panel 100, may be disposed between the sound generating device 1200 of the left area and its peripheral partition 700 and the sound generating device 1200 of the right area and its peripheral partition 700.

Herein, one pair of partitions 700*a* and 700*b* enable a clear division between the sound vibration generated in the sound generating device 1200 of the left area and the sound vibration generated in the sound generating device 1200 of the right area, to thereby improve the stereo sound quality.

Figure 14:
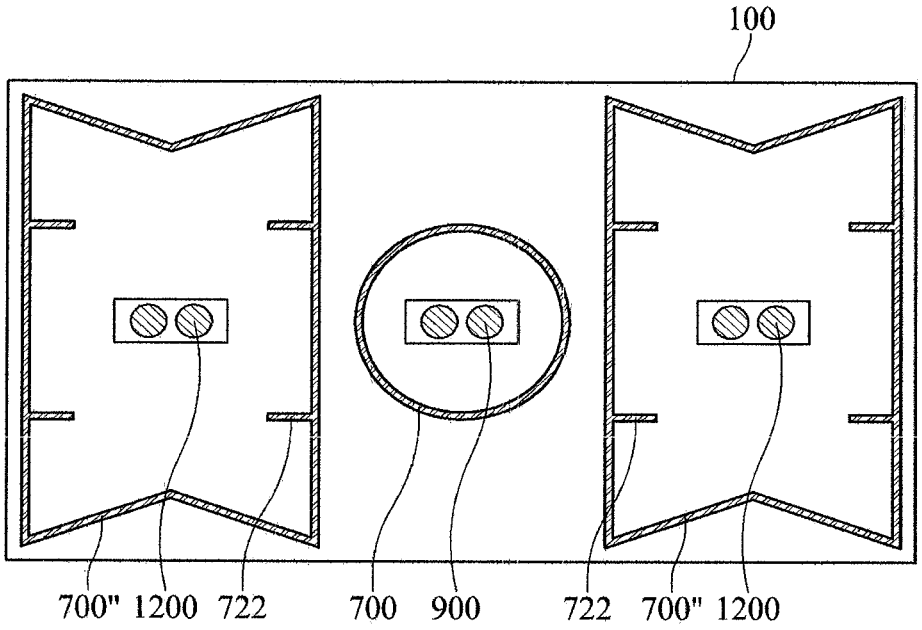

FIG. 14 illustrates an example of the sound generating device 1200 and partition 700 according to the embodiment of the present invention.

There are the low-range sound generating device 900 of the central area, the partition 700 surrounding the low-range sound generating device 900, the sound generating device 1200 in each of the left area and the right area of the display panel 100, and the bowtie-shaped partition 700" surrounding the sound generating device 1200 in each of the left area and the right area of the display panel 100. In detail, if the rear surface of the display panel 100 is divided into first, second, and third areas, the low-range sound generating device 900 and the circular partition 700 are disposed in the second area, the sound generating device 1200 and the polygonal-shaped partition 700" are disposed in each of the first area and the third area. The bowtie-shaped partition 700" may include one pair of vertical linear partition portions provided at left and right sides, and bent portions bent toward the sound generating device 1200 and provided at lower and upper sides.

Also, inward protrusion portions 722 may be additionally formed in one pair of vertical linear partition portions provided at left and right sides of the bowtie-shaped partition 700".

This shape is one of optimal shapes for optimizing the vibration of the middle-range and high-range sound generated in the sound generating device 1200.

In the display apparatus according to the present invention, one pair of sound generating devices may be disposed in the left area and the right area of the display panel 100 so that it is possible to realize the stereo sound output.

The display apparatus according to the present invention includes one pair of sound generating devices disposed in the left area and the right area of the display panel 100, and the sound generating device disposed in the central area of the display panel 100 so that it is possible to realize the stereo sound output.

Also, the display apparatus according to the present invention includes the partition for surrounding the sound generating device so that it is possible to improve the sound vibration efficiency of the sound generating device.

In the display apparatus according to the present invention, the partition disposed to surround the sound generating device may be formed in shape of circle, rectangle, bowtie, and etc., so that it is possible to realize the uniform sound wave and to realize the improved sound quality. The display device according to the embodiment of the present invention may include liquid crystal display (LCD) devices, field emission display (FED) devices, organic light emitting display (OLED) devices, quantum dot display devices, and etc.

The display apparatus according to the present invention may include a liquid crystal module (LCM) including a display panel and a driver for driving the display panel, an organic light emitting display module (OLED), and a quantum dot module (QD). In addition, the display apparatus according to the present invention may also include equipment displays including complete product or final product of LCM, OLED, or QD module, for example, notebook computer, television, computer monitor, automotive display, or vehicle display, and set electronic devices or set device (set apparatus) such as mobile electronic devices of smart phone or electronic pad.

The display apparatus according to the embodiment of the present invention includes the display panel for displaying an image, the supporting member for supporting the rear surface of the display panel, at least one sound generating device disposed between the supporting member and the display panel, at least one partition provided at a predetermined interval from at least one sound generating device, and the adhesion member disposed in the periphery of the display panel.

According to the embodiment of the present invention, the partition is formed in a shape capable of maintaining the same rotation radius with respect to at least one sound generating device.

According to the embodiment of the present invention, the partition is formed in a polygonal shape with the bent portion provided at the same distance from at least one sound generating device.

According to the embodiment of the present invention, the partition includes the first partition having a shape capable of maintaining the same rotation radius with respect to at least one sound generating device, and the second partition having a polygonal shape with a bent portion provided at the same distance from at least one sound generating device.

According to the embodiment of the present invention, at least one sound generating device includes one pair of sound generating devices, and the fixing device for fixing one pair of sound generating devices to each other, wherein an interval distance between each sound generating device included one pair of sound generating devices is smaller than a diameter of the sound generating device.

According to the embodiment of the present invention, a plurality of node points are provided between the partition and the sound generating device.

According to the embodiment of the present invention, the plurality of node points and the partition are formed of the same material.

According to the embodiment of the present invention, the sound generating device includes the supporting plate, the magnet, the voice coil, and the center pole.

According to the embodiment of the present invention, the display panel is divided into first, second, and third areas, and the partition includes the partition provided to maintain the same rotation radius with respect to one pair of sound generating devices and disposed in each of the first area and the third area of the display panel, and the partition disposed in the second area of the display panel.

According to the embodiment of the present invention, the display panel is divided into first, second, and third areas, and the partition includes the partition provided to maintain the same rotation radius with respect to one pair of sound generating devices and disposed in the second area of the display panel, and the partition disposed in each of the first area and the third area of the display panel.

According to the embodiment of the present invention, the partition disposed in each of the first area and the third area of the display panel further includes bent portions provided at its lower and upper sides, and inward protrusion portions provided at its left and right sides.

The display apparatus according to the embodiment of the present invention includes the display panel for displaying an image, at least one pair of sound generating devices on a rear surface of the display panel, the supporting member disposed on the rear surface of the display panel and provided to support at least one pair of sound generating devices, the partition for preparing a space in the display panel with respect to at least one pair of sound generating devices, and the adhesion member for adhering the display panel to the supporting member.

According to the embodiment of the present invention, the partition is provided on the circumference of the same radius with respect to the sound generating device.

According to the embodiment of the present invention, the partition is formed in a polygonal shape with a bent portion provided at the same distance from the sound generating device.

According to the embodiment of the present invention, at least one node point is provided inside the partition.

According to the embodiment of the present invention, the node point and the partition are formed of the same material.

According to the embodiment of the present invention, the sound generating devices of one pair, which are adjacent to each other and are fixed to each other by the use of fixing device, are in contact with the display panel.

According to the embodiment of the present invention, the sound generating device includes the supporting plate, the magnet, the voice coil, and the center pole.

According to the embodiment of the present invention, one pair of the sound generating device is formed in a type where the magnet is disposed inside the voice coil.

According to the embodiment of the present invention, the respective sound generating devices are disposed in the left and right areas of the display panel, and the central area of the display panel, wherein middle-ranged and high-ranged sound is generated in the left and right areas of the display panel, and low-ranged sound is generated in the central area of the display panel.

According as the display apparatus according to the present invention includes the sound generating device which vibrates the display panel so as to generate the sound, it is possible to output the sound to the front direction of the display panel, and furthermore, to enhance a user's sense of immersion.

According as the display apparatus according to the present invention includes the sound generating device which vibrates the display panel so as to generate the sound, there is no need for an additional speaker, whereby it is impossible to realize good design of a set apparatus, and high selectivity in arrangement of a speaker.

In the display apparatus according to the present invention, the supporting member and the sound generating device are fixed to each other by the use of nut and screw included in the supporting member so that it is possible to reduce a thickness of the display panel.

The display apparatus according to the embodiment of the present invention includes the fixing device for fixing one pair of sound generating devices so that it is possible to maintain uniform sound pressure in the entire frequency range, to thereby improve the sound output properties.

The display apparatus according to the present invention includes the fixing device for fixing one pair of sound generating devices, and the plurality of rib portions in the periphery of the sound generating device so that it is possible to maintain hardness of the sound generating device, and to minimize the change of sound output properties even in a case of long-time use.

In the display apparatus according to the present invention, one pair of sound generating devices may be disposed in the left area and the right area of the display panel 100 so that it is possible to realize the stereo sound output.

The display apparatus according to the present invention includes one pair of sound generating devices disposed in the left area and the right area of the display panel 100, and the sound generating device disposed in the central area of the display panel so that it is possible to realize the stereo sound output.

Also, the display apparatus according to the present invention includes the partition for surrounding the sound generating device so that it is possible to improve the sound vibration efficiency of the sound generating device.

In the display apparatus according to the present invention, the partition disposed to surround the sound generating device may be formed in shape of circle, rectangle, bowtie, and etc., so that it is possible to realize the uniform sound wave and to realize the improved sound quality.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A display apparatus, comprising:

a display panel configured to display an image and having a left area and a right area;

a supporting member on a rear surface of the display panel;

a first sound generating device in the left area and a second sound generating device in the right area, the first and second sound generating devices between the supporting member and the display panel and configured to vibrate the display panel to generate sound;

a first partition surrounding the first sound generating device;

a second partition surrounding the second sound generating device; and an adhesion member between the supporting member and the display panel, wherein the adhesion member is disposed in a periphery of the supporting member and the display panel, and wherein the first partition and the second partion are spaced apart from the adhesion member.

2. The display apparatus according to claim 1, wherein the first and second partitions include a shape configured to maintain a same rotation radius with respect to the first and second sound generating devices, respectively.

3. The display apparatus according to claim 1, wherein the first partition has a same shape as the second partition.

4. The display apparatus according to claim 1, wherein the first partition has a different shape from the second partition.

5. The display apparatus according to claim 1, wherein the first and second partitions include one of a circular shape and a polygonal shape.

6. The display apparatus according to claim 1, further comprising at least one node point between the first partition and the first sound generating device, and between the second partition and the second sound generating device.

7. The display apparatus according to claim 6, wherein the at least one node point is formed of a same material as one of the first and second partitions.

8. The display apparatus according to claim 1, further comprising at least one node point around one of the first partition and the second partition.

9. The display apparatus according to claim 1, further comprising at least one node point in the first partition or in the second partition.

10. The display apparatus according to claim 1, further comprising at least one third partition between the left area and the right area.

11. The display apparatus according to claim 1, wherein the first and second partitions have a polygonal shape having a bent portion bent toward the first and second sound generating devices, respectively.

12. The display apparatus according to claim 1, wherein the first partition has one or more of a different shape from the second partition, a different size from the second partition, and a same size as the second partition.

13. A display apparatus, comprising:

a display panel configured to display an image and having a left area, a right area, and a central area;

a supporting member on a rear surface of the display panel;

a plurality of sound generating devices on the rear surface of the display panel and configured to vibrate the display panel to generate sound, the sound generating devices including a first sound generating device in the left area and a second sound generating device in the right area;

a first partition surrounding the first sound generating device;

a second partition surrounding of the second sound generating device; and an adhesion member between the supporting member and the display panel, wherein the adhesion member is disposed in a periphery of the supporting member and the display panel, and wherein the first partition and the second partion are spaced apart from the adhesion member.

14. The display apparatus according to claim 13, wherein one of the first partion and the second partition is configured to maintain a same rotation radius with respect to a corresponding one of the first and second sound generating devices.

15. The display apparatus according to claim 13, wherein one of the first partion and the second partition has one or more of a polygonal shape, a rectangular shape, a circulart shape, and an oval shape.

16. The display apparatus according to claim 13, further comprising a third partition between the left area and the right area.

17. The display apparatus according to claim 13, further comprising:

a third sound generating device in the central area; and a third partition surrounding the third sound generating device.

18. The display apparatus according to claim 17, wherein the third sound generating device includes a low-range sound generating device.

19. The display apparatus according to claim 13, further comprising:

a third sound generating device in the central area; and a third partition surrounding the third sound generating device, wherein the first partition, the second partition, and the third partition have a same shape.

20. The display apparatus according to claim 13, further comprising:

a third sound generating device in the central area; and a third partition surrounding the third sound generating device, wherein a shape of third partition is different from a shape of one of the first partition and the second partition.

21. The display apparatus according to claim 13, further comprising:

a third sound generating device in the central area; and a third partition surrounding the third sound generating device, wherein the first and second partitions have a polygonal shape having a bent portion bent toward the first and second sound generating devices, respectively.

22. The display apparatus according to claim 13, further comprising at least one node point in the first partition or in the second partition.

23. The display apparatus according to claim 13, wherein the first and second partitions include bowtie-shaped partitions.

24. The display apparatus according to claim 13, wherein the first and second partitions include a pair of vertical linear partition portions at left and right sides, and a plurality of bent portions bent toward the first and second sound generating devices, respectively, at lower and upper sides.

25. The display apparatus according to claim 13, wherein the first and second partitions include a bent portion bent toward the first and second sound generating devices, respectively, at a first side of the first and second partitions and at least one protrusion portion at a second side vertical to the first side.

26. The display apparatus according to claim 13, further comprising:

a plate between the sound generating devices and the display panel.

27. The display apparatus according to claim 26, wherein the plate is formed of a thermal conductivity material.

28. The display apparatus according to claim 13, wherein the first partition has one or more of a different shape from the second partition, a different size from the second partition, and a same size as the second partition.

* * * * *